US005937839A

United States Patent [19]

Nilsson et al.

[11] Patent Number: 5,937,839

[45] Date of Patent: Aug. 17, 1999

[54] CLAY TARGET/PIGEON THROWING MACHINE

[75] Inventors: Sten Nilsson, Campbell, Calif.; Ingemar Axen, Storfors, Sweden

[73] Assignee: Beomat Sweden Aktiebolag, Storfors, Sweden

[21] Appl. No.: 08/875,170

[22] PCT Filed: Jan. 17, 1996

[86] PCT No.: PCT/SE96/00033

§ 371 Date: Sep. 3, 1997

§ 102(e) Date: Sep. 3, 1997

[87] PCT Pub. No.: WO96/22502

PCT Pub. Date: Jul. 25, 1996

[30] Foreign Application Priority Data

Jan. 18, 1995 [SE] Sweden ..... 9500155

[51] Int. Cl.[6] ..... F41J 9/18

[52] U.S. Cl. ..... 124/8

[58] Field of Search ..... 124/8, 42, 43, 124/47

[56] References Cited

U.S. PATENT DOCUMENTS

| | | | |
|---|---|---|---|
| 3,189,015 | 6/1965 | Foster | 124/51.1 X |
| 3,304,928 | 2/1967 | Darrell | 124/51.1 X |
| 3,937,203 | 2/1976 | Riedmueller et al. | 124/8 |
| 3,937,204 | 2/1976 | Alday et al. | 124/9 |
| 4,706,641 | 11/1987 | Cote et al. | 124/8 |
| 5,249,563 | 10/1993 | Patenaude | 124/8 |
| 5,406,928 | 4/1995 | Panara et al. | 124/8 |
| 5,771,874 | 6/1998 | Kohler | 124/8 |

FOREIGN PATENT DOCUMENTS

| | | | |
|---|---|---|---|
| 0 592 344 | 4/1994 | European Pat. Off. . | |
| 6800716 | 7/1968 | Netherlands | 124/8 |
| 500 628 | 8/1994 | Sweden . | |
| 87/01191 | 2/1987 | WIPO . | |

*Primary Examiner*—John A. Ricci

*Attorney, Agent, or Firm*—Griffin, Butler Whisenhunt & Szipl, LLP

[57] ABSTRACT

The present invention relates to a clay pigeon throwing machine comprising a secondary throwing table (29), elements (130, 154) for placing clay pigeons in a throwing position on the throwing table (29), a throwing arm (75) fixedly secured to a main axle (60), which main axle (60) is connected to an element (70) for urging the throwing arm (75) in a rapid acceleration and thus throwing the clay pigeon from the throwing table (29). The invention is characterized in that the elements (130, 154) are arranged so as to place two clay pigeons in throwing position so that two clay pigeons are thrown simultaneously in the same plane by the throwing arm (75).

12 Claims, 9 Drawing Sheets

160
164

166
130
152
148
154
160
168
169
162
167
IVb
IVb
75
30
34
35
36
77
95
79
40
21
29
46
45
44
42
44
45
46
24
38
39
22
25

CLAY TARGET/PIGEON THROWING MACHINE

TECHNICAL FIELD

The invention relates to a clay pigeon throwing machine for simultaneously throwing two clay pigeons/targets.

BACKGROUND INFORMATION AND SUMMARY OF THE INVENTION

Clay pigeon throwing machines for shooting practices and competition are available in a wide variety of designs and complexity ranging from very simple hand throwers to fully automated throwing machines having a large storage for clay pigeons. The throwing machines may, for example, be voice activated to discharge the clay pigeons. A conventional clay pigeon throwing machine usually includes a frame having a plane throwing table on which the clay pigeon may be positioned. A spring biased throwing arm may be turned about a vertical axle by a motor so that the arm is in contact with the clay pigeon while the spring is loaded. When the clay pigeon is to be discharged, the arm is released and permitted to rotate quickly about the axle due to the loaded spring. In this way, the clay pigeon is propelled from the throwing table while the clay pigeon is caused to rotate due to the friction between the throwing arm and the clay pigeon when the pigeon is rolled along the arm. To increase the difficulty for the shooter, the throwing machines are often equipped with various mechanisms to vary the direction of the throw both in the horizontal and the vertical planes. This is often achieved by rotating the throwing machine about a vertical and a horizontal axle. A separate motor drives the throwing machines about the axles for each movement. There are rules within competitive target shooting about how much the throwing machines may be turned and how random the movements of the throwing machines can be.

So called hunting paths or trails have in recent years become popular among hunters and shooters. These are usually special trails in the forest having shooting stations that the hunters pass. The clay pigeon throwing machines are, for example, situated at these stations. In may be difficult to provide the throwing machines with power when they are placed in the forest. Therefore, throwing machines powered with 12 volts have been developed. The hunting trails are either permanent or temporary. Both cases require that the equipment is not too heavy because it is often desirable at the permanent hunting paths to change the shooting stations to vary the hunting trails. The temporary hunting trails require that the equipment is packed after the day is over. At the same time, the throwing machine must not be unstable.

Thanks to double clay target traps, that are designed according to regulations, and the increased popularity of hunting trails, there is an increasing demand for throwing machines that have the ability to throw two clay pigeons simultaneously. A few machines have been developed in an attempt to satisfy this need. These machines often have two throwing arms etc. and are clumsy, heavy and do not function satisfactorily. Therefore, these machines have not been particularly successful.

One objective of the present invention is to provide a clay pigeon throwing machine with the ability to simultaneously throw two clay pigeons while being easy to handle.

This objective is achieved by a device according to the annexed claims.

BRIEF DESCRIPTION OF DRAWINGS

A description of the drawings of the preferred embodiment of the present invention is provided below.

DETAILED DESCRIPTION OF A PREFERRED EMBODIMENT

Figure 1:
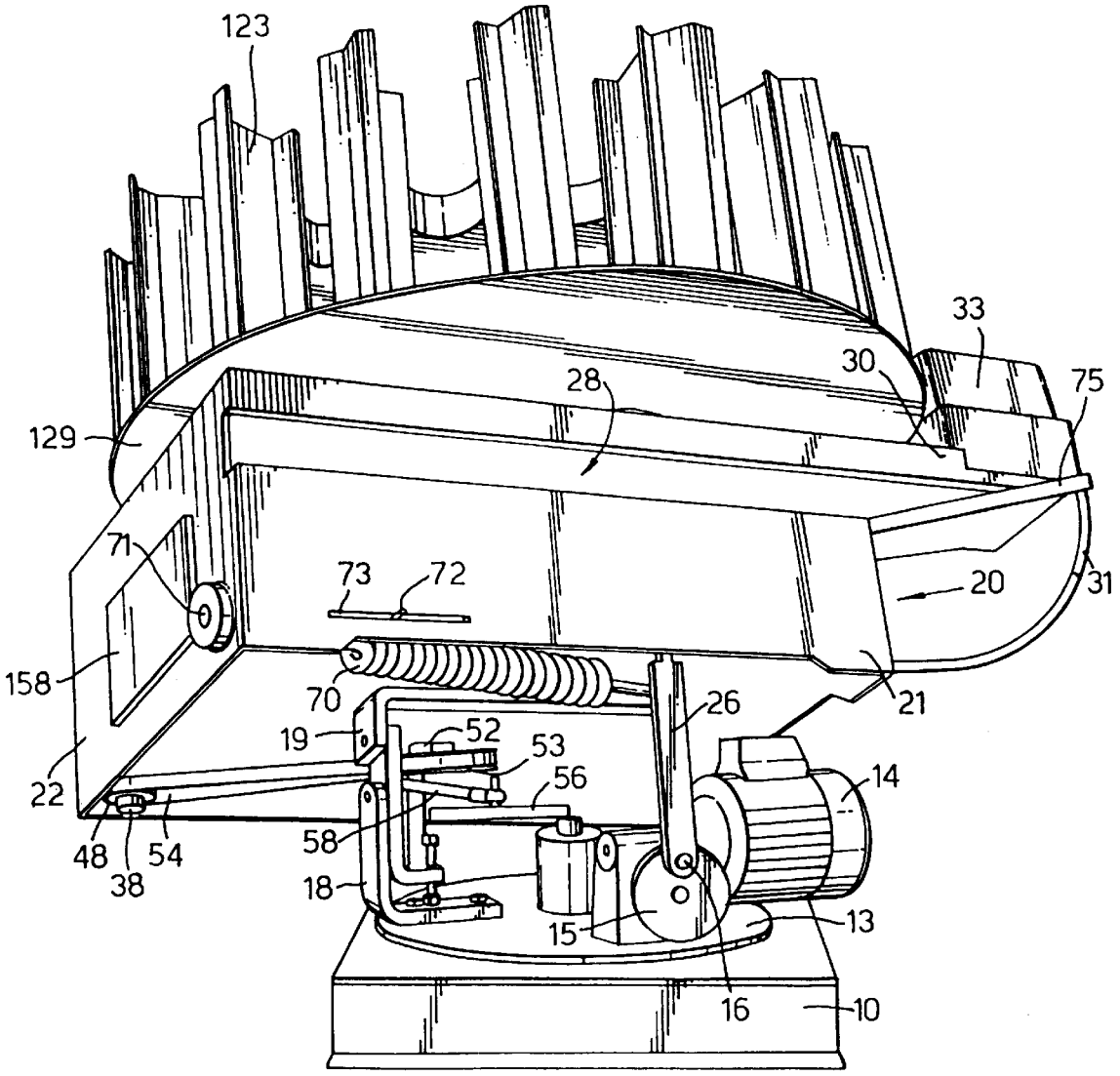
FIG. 1 is a perspective view of the front and the left sides of the clay pigeon throwing machine of the present invention.
Figure 3:
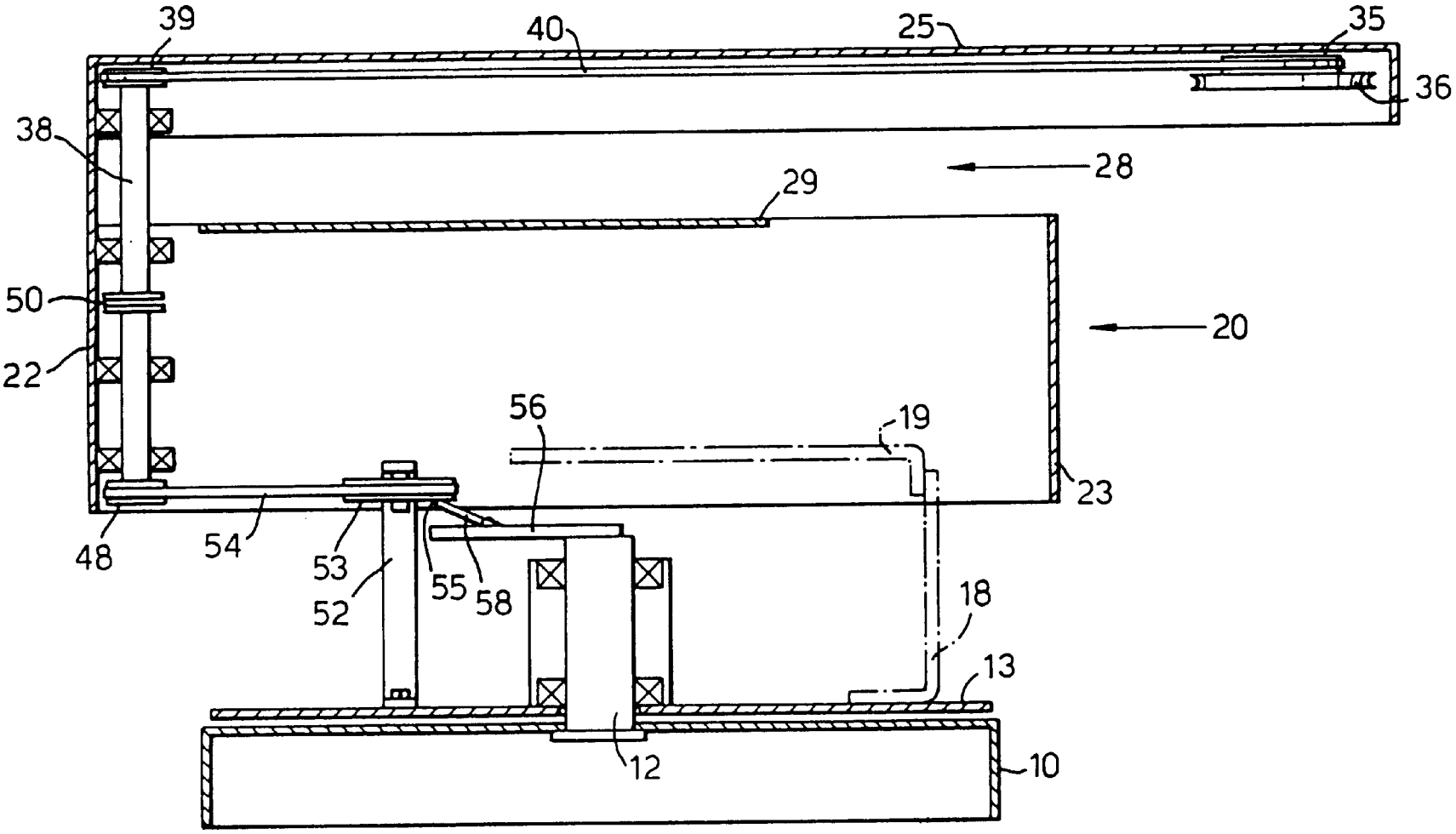
FIG. 3 is a schematic cross sectional view of the throwing mechanism showing the mechanism for turning the frame of the throwing machine to select the direction of the propulsion of clay pigeons.

A preferred embodiment of the present invention includes a bottom plate 10 mounted on a suitable support structure, as shown in FIGS. 1 and 3. A vertical axle 12 is rigidly mounted on the bottom plate 10. A turning plate 13 is rotatably attached to the vertical axle 12. An electric motor 14 including a gear is attached to the turning plate 13. A disc 15 is attached to a protruding rod of the gear. An attachment member or pin 16 is eccentrically attached to the disc 15. The turning plate 13 also includes two L-shaped members 18. At the upper end of the vertical portion of the L-shaped members 18 is a horizontal member 19 rotatably attached by two downwardly protruding flanges. The horizontal member 19 is secured to an under side of a frame 20. The frame 20 is preferably square having vertical side walls 21–24 and a top surface 25. An arm 26 is connecting the underside of the frame 20 to the pin 16.

Figures 4, 4B:
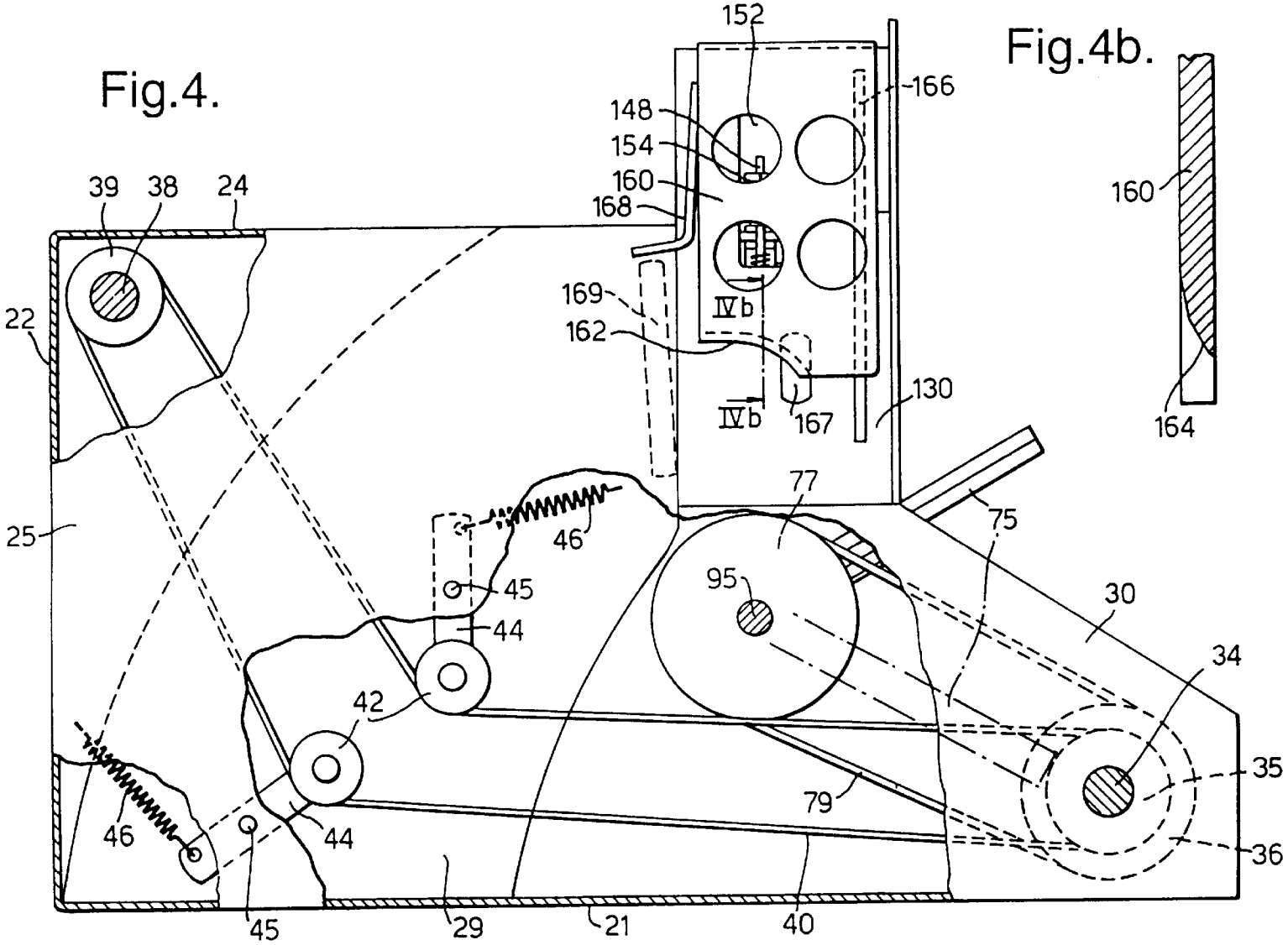
FIG. 4 is a top view of the throwing mechanism showing the connection of the outward driving axle and the driving components. The clay pigeon storage, sliding plate and main motor have been removed.
FIG. 4*b* is a detailed view along IVb—IVb in FIG. 4 and shows the chamfered portion of the front end of the guiding plate.

Three of the side walls of the frame 20 have horizontal sections removed along the whole front wall 21, the whole right side wall 23, as viewed from the front, and a large portion of the rear side wall 24. The removed sections together define a slit shaped opening 28. The front wall 21, the right side wall 23 and the top surface 25 extend horizontally over the under portion of the side wall 23 above the opening 28 to form a motor mount 30. At the lower end of the opening 28 and parallel therewith is a plant surface called a secondary throwing table 29 which is disposed, as shown in FIG. 4. Between the outer end of the motor mount 30 and the right side wall 23 is a bow shaped mount 31 that functions as a support for the portion of the frame 20 that is above the opening 28, as shown in FIG. 1.

An electric motor 32 and a gear box 33 are attached to the motor mount 30. The motor 32 is here refereed to as the main motor. The gear box 33 has a horizontal inward axle and a vertical outward axle 34, as shown in FIG. 4. The axle 34 protrudes through the top surface 25 at the motor mount 30. An electro-magnetic connector is located between the axle of the electrical motor 32 and the inward axle of the gear 33. Immediately below the top surface 25, the gear box 33 has a gear tooth disc 35 and a V-belt disc 36 attached thereto.

In the corner of the frame 20, between the rear side wall 24 and the left side wall 22, is a vertical axle 38 rotatably attached, as shown in FIGS. 3 and 4. The upper end of the axle 38 includes a gear tooth disc 39 that is in the same horizontal plane as the gear tooth disc 35 of the axle 34 of the gear. A belt 40 extends between the two gear tooth discs via two guide rolls 42. The guide rolls 42 are rotatably attached to one of the arms of two pivot arms 44. The pivot arms 44 are rotatably attached to bolts 45 that are secured to the under side of the top surface 25. A pulling spring 46 is attached to the other arm. The lower end of the axle 38 terminates slightly above the lower end of the frame 20 and includes a lower V-belt disc 48. The axle 38 is divided and includes a electro-magnetic clutch or connector 50.

An upright and U-shaped member 52 is attached to the rear portion of the turning pate 13 so that the lower end of the member is attached to the turning plate 13. The upper portion of the member includes a V-belt disc 53 that is rotatably attached thereto. The V-belt disc 53 is at the same horizontal plane as the lower V-belt disc 48 of the axle 38. A V-belt 54 extends between both of the V-belt discs 48 and 53. A peg 55 is eccentrically attached to the V-belt disc 53. A horizontal arm 56 is secured to the upper end of the axle 12. The arm 56 has a plurality of fastening points positioned thereon. A pulling arm 58 is attached to the arm 56 and extends between the arm 56 and the peg 55 on the V-belt disc 53.

Figure 5:
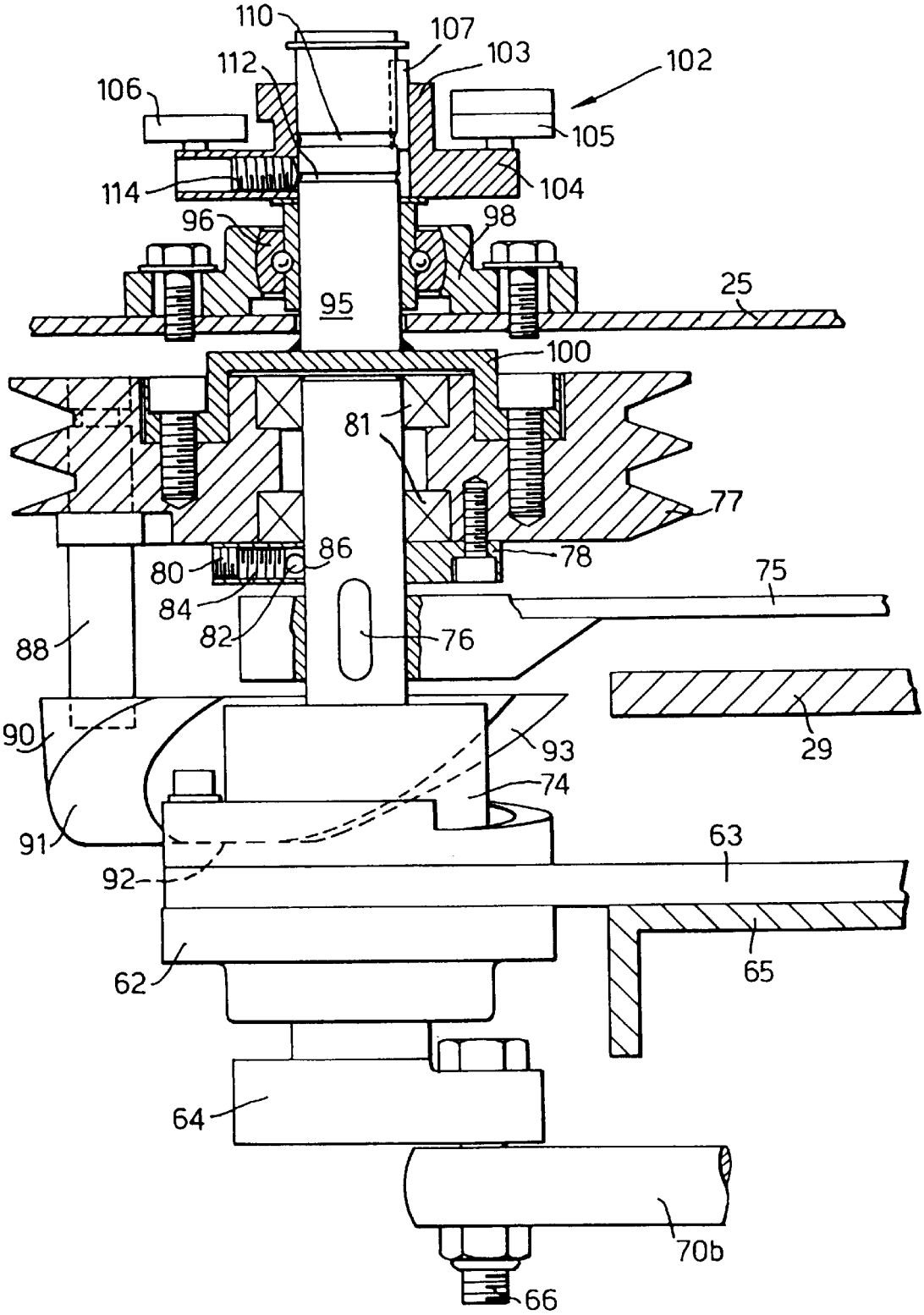
FIG. 5 is a detailed side view of the axle mechanism showing the loading of the throwing arm and the feeding mechanism of the storage including the clay pigeons.
Figure 6:
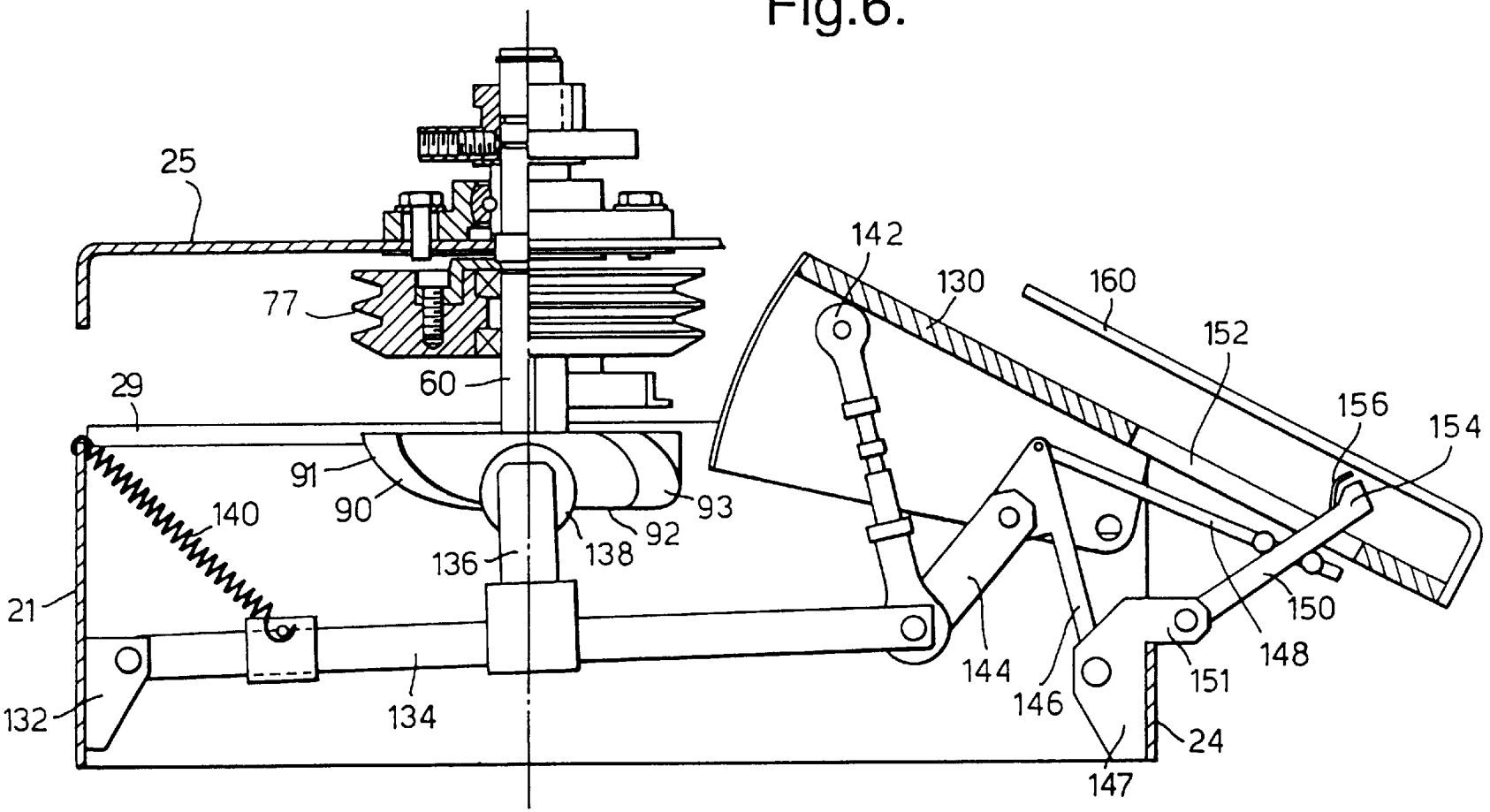
FIG. 6 is a cross sectional view showing a sloping position of the primary throwing table.
Figure 7:
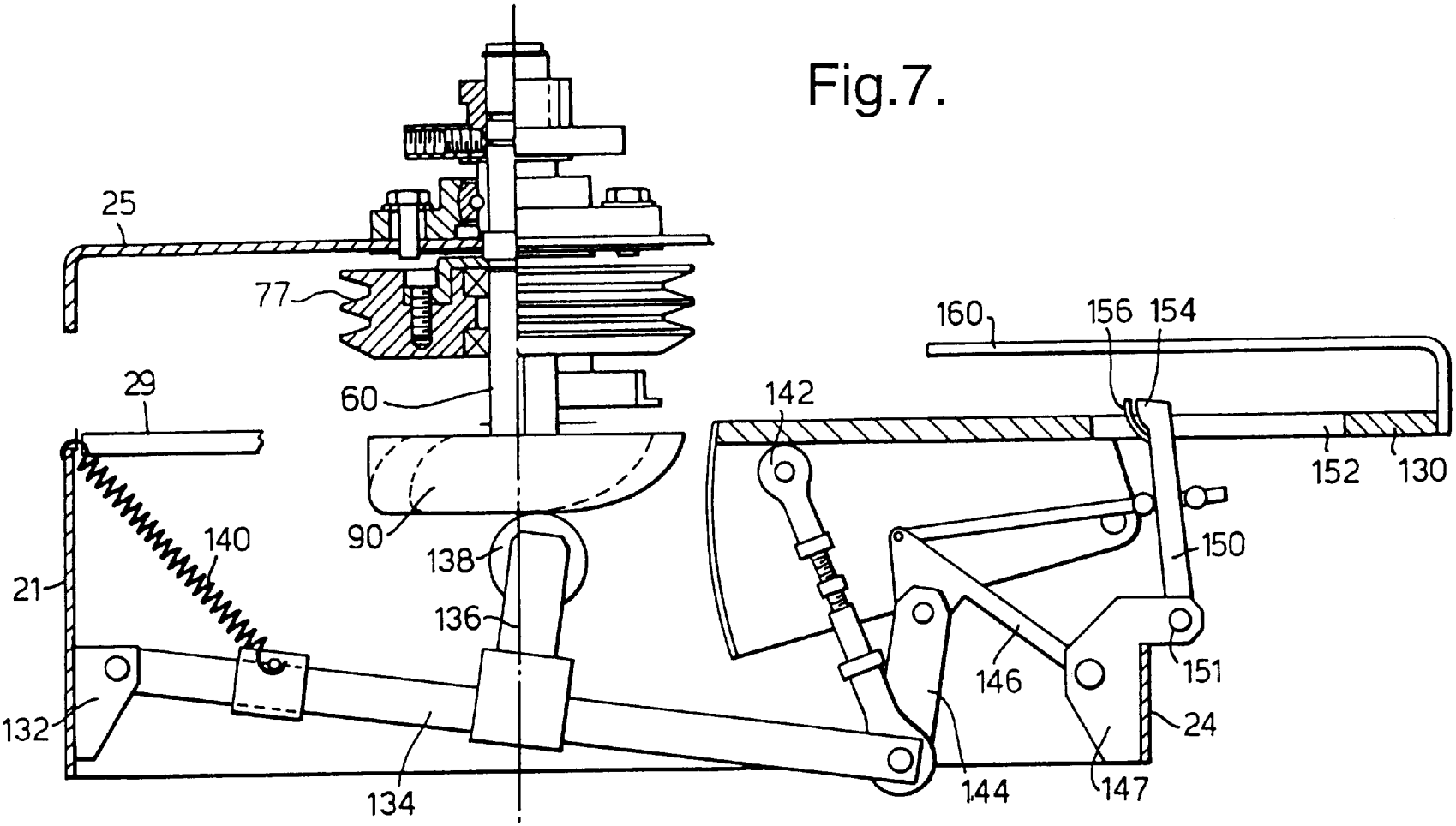
FIG. 7 is a cross sectional view showing the primary throwing table in a position parallel to a secondary throwing table.

A vertical axle 60 is attached to the frame 20. This axle is referred to as the main axle. The axle is attached to the right side of the frame 20, as viewed from the front, and is adjacent the font end as viewed from the right side of the frame 20, as shown in FIGS. 5 and 6. The axle 60 is rotatably attached to a bearing 62 that is attached to a support plate 63 that in turn is attached to a beam system 65 in the frame 20. A pivot arm 64 is attached to the lower end of the axle 60. The pivot arm 64 has a bolt 66 attached to one end thereof. A powerful spring 70, FIG. 1, and a spring holder bar **70*b* are attached to the pivot arm 64 by the bolt 66, FIG. 5. The other end of the spring 70 is attached to the left side wall 22, at the corner of the front side wall 21, by a threaded bolt 71. The pre-set tension of the spring 70 may be adjusted by the bolt 71. The pre-set tension may be indicated by a pin 72 that is attached to the spring 70, as shown in FIG. 1. The pin 72 is perpendicular to the spring and protrudes through a slit 73 defined in the front side wall 21. The harder the spring is loaded, the more the pin 72 moves to the left within the slit 73. The main axle 60 has a free wheel hub 74, as shown in FIG. 5, so that the main axle 60 may only be rotated counter clockwise but not clockwise. A throwing arm 75 is secured to the main axle 60 by, for example, a wedge 76 inserted through an opening defined in the main axle 60 and the throwing arm 75. The throwing arm 75 is attached to the main axle 60 so that the arm holder extends parallel to and is disposed at a certain distance above the throwing table 29**.

A V-belt disc 77 in rotatably attach to the upper end of the axle 60 by a bearing 81. The V-belt disc 77 is rotatably attached by a belt 79 to the disc 36 at the outward axle 34 of the gear, as shown in FIG. 4. A positioning member 78 is attached to the V-belt disc 77 so that the member may rotate about the main axle 60. The member 78 has an opening 80 defined therethrough and includes a spring biased positioning member or ball 82. The tension of the spring that biases the ball may be adjusted by a threaded bolt 84. A recess 86 is defined in the axle 60 to receive the ball. A pushing rod 88 is secured to the periphery of the V-belt disc 77. The rod 88 is perpendicular to the V-belt disc 77 and extends downwardly. The lower end of the rod 88 is attached to an approximately half-circle shaped cam disc 90. The front flange 91 of the disc 90, as seen in the rotational direction, has a slope that is relatively gradual down to a straight section 92 that becomes relatively steep at the rear flange 93, as seen in FIGS. 5 and 6.

A second axle 95, herein called upper axle, extends co-axially with the main axle 60. The upper axle 95 extends through the top surface 25 of the frame 20. A bearing 96 is rotatably attached to the upper axle 95 and the bearing is located within a bearing housing 98 that is suitably attached to the top surface 25. The lower end of the upper axle 95 includes a substantially disc shaped fastening member 100 that fits into a recess formed in the top surface 25 so that the upper axle is attached to the V-belt disc 77. In this way, the fastening member 100 is secured to the V-belt disc 77. The upper end of the upper axle 95 includes a feeding member 102 in the form of a socket 103 having a disc shaped flange 104. Two feeder rolls 105, 106 are rotatably attached to two pin that arm parallel with the axle 95. The feeder roll 105 is twice as high as the feeder roll 106. The feeding member 102 may be set, with regard to the rotational position thereof by a wedge 107 on the axle 95 and a groove 108 defined in the flange. The member 102 may be adjusted axially to two different positions as defined by two peripheral grooves 110, 112 that are defined in the axle 95. The grooves are axially spaced apart. The position of the member 102 may also be adjusted by a radially inward and spring biased setting member 114 defined in the flange 104. The axial position of the member 102 are limited by two setting rings. A positioning indicator 115, having the form of a metal pointer, is attached to the flange of the bearing 96 and protrudes radially outwardly from the upper axle 95.

Figure 2:
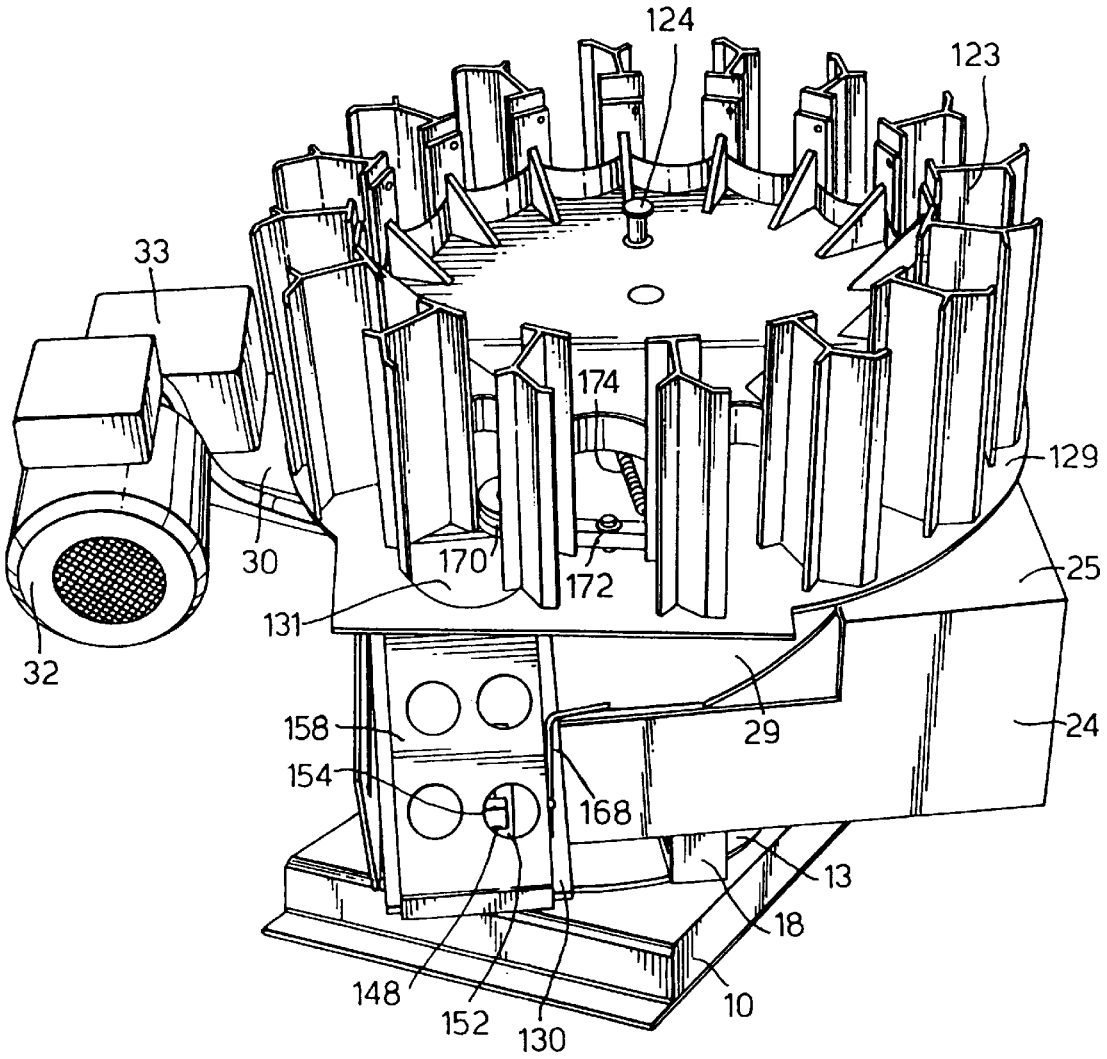
FIG. 2 is a perspective view of the rear side and top side of the present invention.
Figure 8:
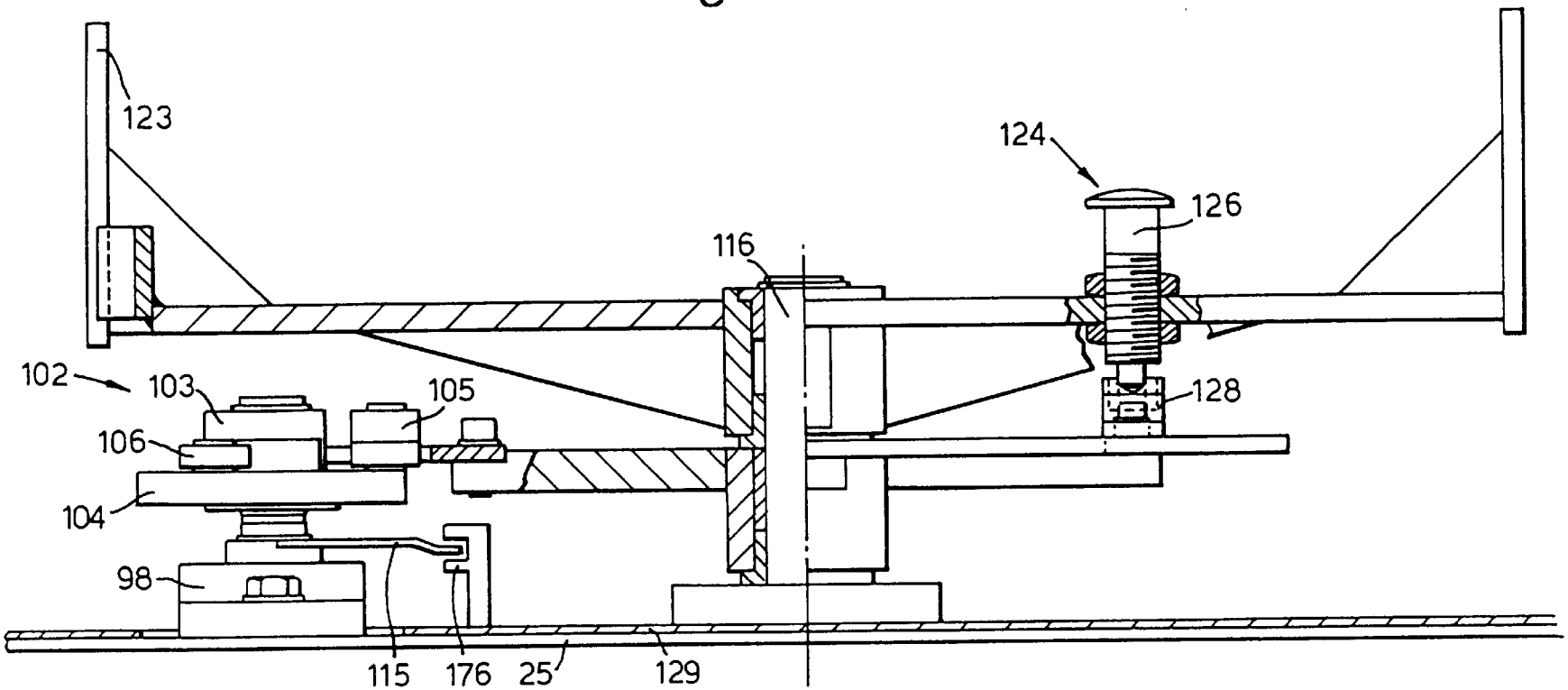
FIG. 8 is a detailed view of the feeding member, the dividing plate and the storage.
Figure 9:
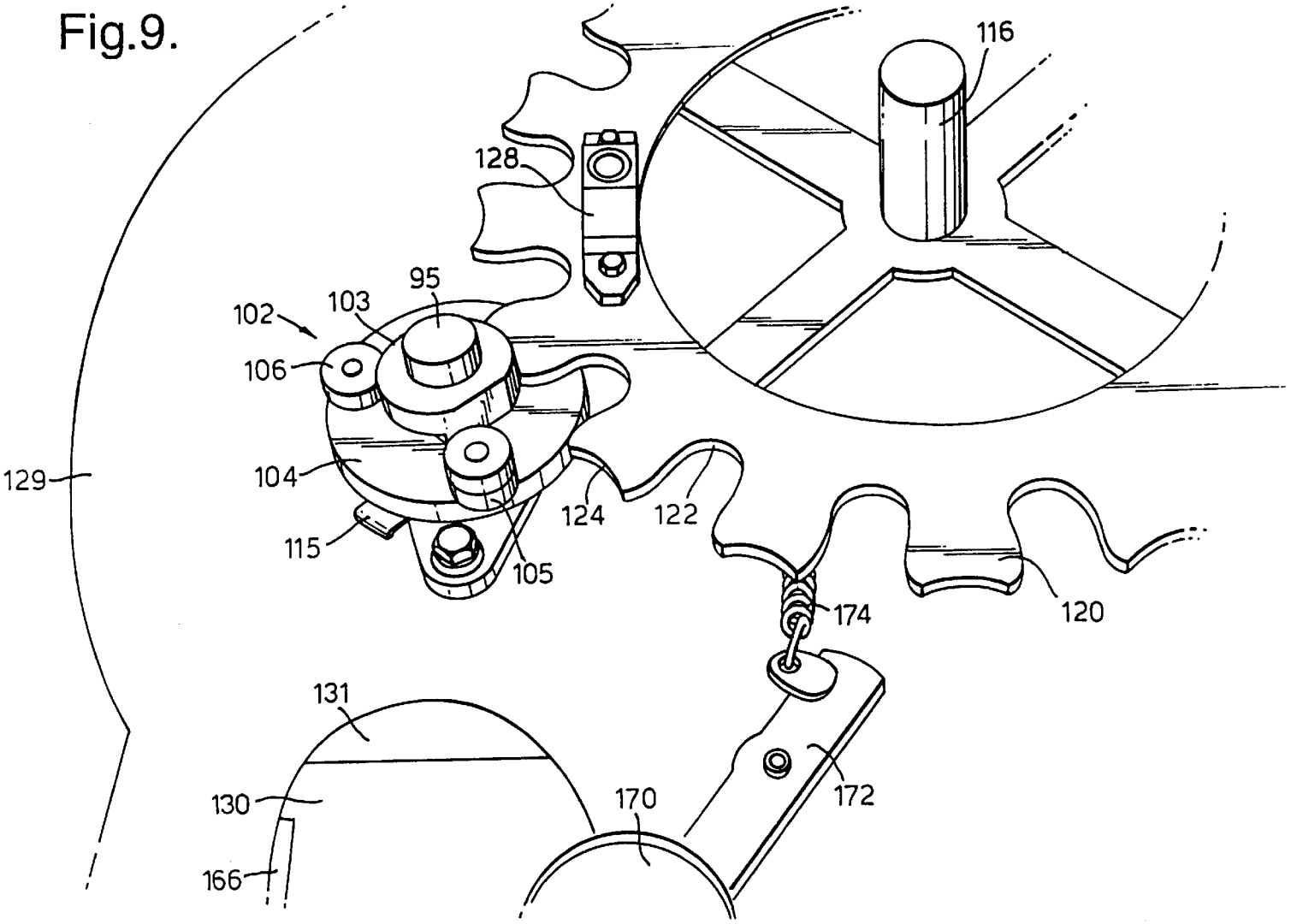
FIG. 9 is a detailed view of the feeder member engaging the dividing plate. The figure also shows the pigeon holding wheel mechanism and the opening defined in the sliding plate.

A storage axle 116 is perpendicularly attached to the top surface 25, as shown in FIGS. 8 and 9. A dividing plate 120, having specially shaped teeth, is rotatably attached to the storage axle 116. The bottom of the teeth are curved to conform with the shape of the feeder rolls 105, 106 and are then slightly widened. The teeth are wide and has a concave shape at an protrusion end 124. The shape of the end 124 conforms to the rounded shape of the socket 103. Due to the shape of the dividing plate 120 and the member 102 they are constantly meshed to one another. A storage magazine 123 for clay pigeons, in conformance with international standards, having room for sixteen stacks of clay pigeons, are rotatably attached to the axle 116 above the dividing plate 120. The storage 123 is connected to the dividing plate 120 by a locking member 125. The locking member includes an axially shiftable and spring biased pin 126. The pin has a gripping handle at one end and a peg at the other end. The peg is adapted to fit into a hole in a locking member 128. The locking member 128 is attached to the upper side of the dividing plate 120. The locking member 128 includes a flange in which the peg may slide within to fit into the hole. A round sliding plate 129 is attached to the top surface 25. The diameter of the sliding plate is slightly larger than the diameter of the storage 123. The sliding plate 129 has an opening 131 defined therein that is substantially oval and is slightly larger than a clay pigeon. The sliding plate 129 also includes a pigeon holding wheel 170 that is rotatably attached to one end of a double armed pivot bar 172 that is positioned adjacent the opening 131, as shown in FIGS. 2 and 9. The other end is attached to a pulling spring 174. FIG. 9 shows the wheel 170 in an unloaded state with the storage 123 removed. When the storage 123 is mounted, the pigeon holding wheel rolls are on the inside of the storage 123. The sliding plate 129 is equipped with a fork shaped body 176 that is designed so that the positioning indicator 115 may fit between the fork fingers.

A primary throwing table 130 is rotatably attached to a horizontal axle adjacent to and parallel with the rear side wall 24 at the back side of the frame 20. The primary throwing table 130 extends rearwardly from the rear side wall 24. A main arm 134 extends from a fastener 132 at the font side wall 21 to the primary throwing table 130 so that the arm is parallel to the side wall 23. The main arm is also positioned so that it extends below the disc 90. A linking arm 136 is attached to the main arm 134 and extends upwardly. The linking arm 136 is at the same level as the main axle 60. A guide roll 138 is rotatably attached to one end of the linking arm 136. A pulling spring 140 is also attached to one end of the main arm 134. One end of the spring 140 is attached to the inside of the upper edge of the front side wall 21. A first pivot arm 142 is pivotally attached to the other end of the main arm 134. The first pivot arm 142 is attached to the primary throwing table 130 in front of its pivot point. A second pivot arm 144 is also pivotally attached to the other end of the main arm 134. The other end of the second pivot arm 144 is attached to a third pivot art 146. The third pivot arm 146 has one end attached to an attachment 147 attached to the inside of the rear side wall 24. The third pivot atm 146 has a protruding portion including an attachment that is positioned slightly below the other end of the second pivot arm 144. The second pivot arm 144 is rotatably attached to this attachment. A fourth pivot arm 148 is pivotally attached to the upper end of the third pivot arm 146. A shifting arm 150 is attached to the fourth pivot arm 148. The lower end of the shifting arm 150 is pivotally attached to a shaft 151 at the rear side wall 24. The upper portion of the shifting arm 150 extends through an opening 152 defined in the primary throwing table 130. The upper portion includes a protrusion 154 having a blade spring 156 placed in front of the protrusion. A guiding plate 160 is attached to and parallel with the primary throwing table 130 and is disposed a certain distance above the table. The guiding plate 160 includes a curved portion 162, as shown in FIG. 4, along a portion of the inner edge of the guiding plate 160. The curved portion 162 includes a chamfered portion 164, see FIG. 4*b*, from the upper edge and upwardly. The upper side of the primary throwing table 130 includes two guide members 166, 168. The guide member 166 is substantially parallel to and is adjacent one of the edges of the primary throwing table 130. The other guide member 168 is positioned adjacent the other edge and has a certain angle relative thereto. The inner end of the guide member 168 is curved over the secondary throwing table 29.

The electrical components are provided with power via suitable wiring (not shown) and components such as electrical motors, electro-magnetic clutches and transmitters are controlled by electronics including, among other things, a random generator which electronics are arranged within door 158 located on the left side wall 22.

The invention operates as follows. When the power is turned on to the clay pigeon throwing machine via a main switch, the electronics is activated and the main motor 32 starts rotating. The electrical motor 14 also starts to rotate to set the height of the frame 20 and this motor will continuously rotate as long as the power is switched on. The rotation is transferred via the gear to the disc 15. The arm 26, that is attached to the eccentrically positioned pin 16 and extends to the frame 20, causes the frame 20 to rotate about the attachment points between the members 18 and 19. In this way, the vertical direction of the clay pigeons discharge is regulated. If the throwing machine is not used within a time period of about five minutes, the electronics turn off the power to the motors to save on electricity and to save the motors 14 and 32. The control of the throwing machine may be performed remotely, either by a key board or by voice (not shown). When the throwing machine is activated, the random generator is turned on and the electro-magnetic connector disposed between the main motor 32 and the gear 33 is activated. The belt dins 35, 36, attached to the outward axle 34 of the gear, start to rotate and pull the belts 40 and 79. The belt 40 transfers rotation to the axle 38 via the guide rolls 42. The random generator in the electronics controls the electro-magnetic connector 50 on the axle 38. When the connector 50 is turned off, the upper portion of the axle 38 is unaffected and continues to rotate. When the connector 50 is turned on, the lower part of the axle also starts to rotate. The spring biased guide rolls 42 reduce any rapid jerks of the belt 40 when the connector 50 is turned on and provides a smoother rotation and less load on the belt 40. When the connector is turned on, the lower V-belt disc 48 starts to rotate so that the V-belt 54 starts pulling. This belt transfers rotation to the disc 53 attached to the elongate member 52 which in turn is secured to the turning plate 13. The eccentrically positioned attachment or peg 55 on the disc 53 and the arm 58, that is attached to the attachment 55, and the arm 56 attached to the axle 12, cause the turning plate 13, and thus the frame 20, to turn in a back and forth movement about the axle 12. The amount of swing movement may be varied by moving the arm 58 to different attachment points along the attachment arm 56. As mentioned earlier, the electro-magnetic connector 50 is controlled by the random generator to control when connector 50 is turned on and how long it is turned on. In this way, the direction of the throw of the clay pigeons is randomly selected.

The other V-belt disc 36 on the outward axle 34 of the gear transfers the rotation to the V-belt disc 77 via the V-belt 79. The V-belt disc 36 also transfers the rotation to the upper axle 95 attached to the disc that is above and coaxial with the main axle 60. In this position, the disc 90 is approximately diametrically opposed to the roll 138 since the disc 90 is secured to the V-belt disc 77 via the rod 88. That is, the roll 138 and therefore the linking system 134–150 are not under load except for the spring 140 that lifts the main arm 134 so that the primary throwing table 130 is tipped sufficiently so that its forward edge engages to stop extensions attached to an underside of the sliding plate 129. Simultaneously, the arm 150 has its protrusion 154 in its most rearward position.

The rotation of the upper axle 95 causes the member 102 to rotate so that one of the rolls 105 is turned into a tooth recess 122 on the dividing plate 120 so that the dividing plate 120 is turned a bit until the roll 105 is moved out of the engagement with the tooth recess 122. Because the dividing plate 120 is engaging the storage 123 via the locking member 125, the storage 123 is also turned a corresponding distance. This distance corresponds to the rotation that is required to move a stack of clay pigeons to the opening 131 defined in the sliding plate. The pigeon holding wheel 170, that is spring biased against the inside of the storage 123 and the stacks of clay pigeons when the stacks are moved to the opening 131 to the sliding plate, is designed so that it is not in contact with the bottom pigeon in the stack but only the pigeons number 2–4 from the bottom. In this way, only the bottom clay pigeon will fall through the opening 131 when the stack of clay pigeons in the storage 123 is moved to the opening 131 so that the rest of the clay pigeons remain in the storage 123. The clay pigeon that falls down through the opening 131 is first received by the front edge of the guiding plate 160 that is chamfered and rounded. The curved portion 162 and the chamfered portion 164 are carefully designed to ensure the correct position of the clay pigeons on the throwing table 130. As mentioned earlier, the throwing table 130 is urged by the spring 140 and the linking system 134–150 so that the table 130 engages the underside of the sliding plate 129 at the opening 131. The clay pigeon falls, when it is guided over the opening 131 via the guide plate 160, down onto the throwing table 130 so that the forward edge hits the table first. To prevent the relatively fragile clay pigeon from breaking during the fall, although the distance is not great, a dampening material 167 is disposed on the primary throwing table at the place where the pigeon first hits the table. The clay pigeon then comes into contact with the right guide member 166 and due to the slope of the throwing table 130, the clay pigeon slides down the throwing table along the guide member 166 until the pigeon hits the dampening blade spring 156 on the protrusion 154 of the shifting arm 150. The clay pigeon is prevented from sliding off the primary throwing table 130 due to the left guide member 168 and the guide plate 160. While this is happening, the upper axle 95 and the feeding member 102 continue to rotate. If two clay pigeons are to be prepared to be propelled simultaneously, the feeding member 102 is moved in its upper position that is defined by the upper groove 110 on the upper axle 95 and the setting member 114. The feeder roll 106 engages the dividing plate 120 to forward the storage to that the next stack of clay pigeons are positioned over the opening 131 on the sliding plate so that one more clay pigeon may fall down onto the primary throwing table 130. The second clay pigeon is automatically placed next to and in contact with the first clay pigeon while the remaining clay pigeons in the stack are held by the pigeon holding wheel 170. The second clay pigeon is prevented to be placed on top of the first clay pigeon by the guiding plate 160. The upper axle 95 and thus the pushing rod 88 and the cam disc 90 continue to rotate. The socket 103 of the feeding member 102 and the tooth 124 have such as shape and are meshed together so that when the clay pigeons have been permitted to fall down into the opening 131, the dividing plate 120 is locked into position with the socket 103 to prevent undesirable rotation of the dividing plate 120 and thus the storage 123.

The throwing arm 75 may, due to a previous throw, be in a position so that its end portion is pointing in a direction approximately towards the outward axle of the gear box, see dotted line in FIG. 4, as is described in detail below. The front portion of the cam disc 90 is in contact with the guide roll 138 that rolls along the front flange 91 thereof. This results in that the main arm 134 is pushed downwardly and that the system 142–150 turns down the primary throwing table and the protrusion 154 is pushed forwardly within the opening 152 to push the clay pigeons forward and inward towards the main axle 60. When the cam disc 90 is turned further, the guide roll 138 rolls on the straight section 92 and the most downwardly moving part of the cam disc 90. In this position, the primary throwing table 130 is parallel with the secondary throwing table 29 and the protrusion 154 has reached its forward most position so that the clay pigeons may be pushed forward to their throwing position through the guidance of guide members 166, 168. In this way, the clay pigeons may be pushed from the primary throwing table 130 to the secondary throwing table 29 so that the clay pigeons are in a position for discharge from the throwing machine through the opening 28.

The pushing rod 88 is brought into the contact with the throwing arm 75 as the V-belt disc 77 is rotated. The throwing arm 75 is secured to the main axle 60 by the wedge 76 and the pushing rod 88 brings the throwing arm 75 with it as the V-bolt disc 77 rotates. When the upper axle 95 and the main axle 60 are rotating together due to the contact between the pushing rod 88 and the throwing arm 75, the setting members 78–84, which are secured to the V-belt disc 77 and thus to the upper axle 95, are moved to fit into the recess 86 defined in the main axle 60. In other words, the spring biased ball 82 of the setting member is pushed into the recess 86 on the main axle 60. The pivot arm 64 is operatively engaging the main axle 60 so that when the main axle has, with the help of the upper axle 95 and the pushing rod 88, moved the throwing arm to a position adjacent to the throwing position, the pivot arm 64 is pointing in the direction of the extension of the throwing spring 70. That is, the pivot arm 64 has reached its end position so that the throwing spring 70 is under maximum tension. The rotation of the upper axle 95 is only stopped lightly above the end position with the help of the positioning indicator 115 and the fork shaped body 176 that via electronics sends a turn-off signal to the electromagnetic connector. Due to the setting members 78–84, the throwing arm 75 is still held in its throwing position although the end position has been slightly exceeded. This arrangement prevents any time gap to occur when the shooter wants the next clay pigeon to be discharged. In the throwing position, both clay pigeons are in operative engagement with the throwing arm 75. This contact is ensured by a brush mechanism 169 that is attached to the underside of the top surface 25 of the frame 20 so that the brush mechanism is on the side of the throwing arm when the clay pigeons are in position to be discharged and thus urges the clay pigeons against the throwing arm 75. This engagement is important, although previously known, because the clay pigeons would be crushed if they were not in contact with the throwing arm at the time of discharge of the throwing arm.

When the shooter gives the signal to activate a discharge of the clay pigeons, by voice or key commands performed by an assistant, a signal is sent to the electronics that turns on the electro-magnetic connector. This results in a rotation of the upper aide 95 and the pushing rod 88. Because the pushing rod 88 is operatively engaging the throwing arm 75, the throwing arm 75 is shifted an angle so that the biasing force of the throwing spring 70 supersedes the total resistance force by the setting members 79–84. The biasing force of the throwing spring 70 causes the throwing arm to accelerate very fast to propel both of the clay pigeons. The clay pigeons are during the propulsion moved, due to the centrifugal forces, from their position relatively deep inside the throwing arm to move along the front end of the throwing arm. Due to the fact that the front end of the throwing arm has a high friction material coated thereon and that the secondary throwing table 29 has a certain friction, the clay pigeons are caused to rotate rapidly during the moment of discharge while they are propelled forwardly. The rotation of the clay pigeons ensures a good gliding path and stable flight.

The movement energy provided to the throwing arm 75 by the throwing spring 70 causes the throwing arm and the main axle 60 to be turned so that the pivot arm 64 passes its lower end position and the throwing spring 70 is again under tension. The throwing arm 75 and the main axle 60 are prevented by the biasing forces of the throwing spring 70 to be pulled back thanks to the free wheel hub 74 that only allows the main axle 60 to rotate in one direction. In this way, a portion of energy is saved so that the upper axle 95 and the pushing rod 88 do not have to perform all the tensioning of the throwing spring 70. Additionally, the throwing arm 75 does not move back and forth after a discharge which would be the case if the free wheel hub did not lock the throwing arm 75.

If only one clay pigeon is to be discharged, the feeding member 102 is moved to a position as defined by the lower groove 112 on the upper axle 95 and the setting member 114. In this position, only the higher feeder roll 105 engages the dividing plate 120 and the storage 123 is thus forwarded one step so that one clay pigeon is permitted to fall down onto the primary throwing table 130. During the remaining rotation, the same cycle is performed as described above and the dividing plate 120 is locked into the socket 103 of the feeding member 102.

The locking member 125 on the storage 123 permits a disengagement from the dividing plate 120 so that the storage may rotate freely. This disengagement makes it easier to load stacks of clay pigeons into the storage from one position. When the storage 123 has been turned one full circle, the locking member 125 glides along the flange of the locking member 128 to fit into the locking opening.

The throwing machine of the present invention is compact and easy to handle and is adapted for simultaneous discharge of two clay pigeons using only two electric motors that control all the functions of the throwing machine.

It is to be understood that the present invention is not to be limited to the above description and the embodiments shown in the drawings but may be modified within the scope of the following claims. Thus, the setting members 78–84 may be excluded. This means that the rotation of the upper axle 95, the pushing rod 88, and the throwing arm 75 pushed by the pushing rod 88, are stopped slightly before or exactly at the end position to ensure that the throwing arm is not inadvertently released. The end position of the rotation may be set by turning the flange of the bearing 98 on which the positioning indicator of the flange bearing is placed.

We claim:

1. Clay pigeon throwing a machine comprising a bottom plate (10), a turning plate (13) rotatably attached to a vertical axle (12) secured to the bottom plate (10), a frame (20) rotatably attached to a horizontal axle attached to said turning plate (13), said frame (20) having a horizontal secondary throwing table (29), a main axle (60) rotatably attached to said frame (20), a throwing arm (75) secured to the main axle (60) and being disposed slightly above the secondary throwing table (29), a throwing spring (70) attached to the main axle (60) by a pivot arm (64) so that the throwing spring (70) is tentioned by rotation of the main axle (60), a storage (123) having a plurality of housings for holding stacks of clay pigeons positioned above the secondary throwing table (29), a main motor (32) connected to a gear box (33) and an electro-magnetic connector (50) between the main motor (32) and the gear box (33), a primary throwing table (130) disposed in front of the secondary throwing table (29) as viewed in the direction of the rotational movement of the throwing arm (75), the primary throwing table (130) being movable about a horizontal axle between a first position where one edge of the primary throwing table (130) is in contact with the underside of the storage (123) and a second position where the primary throwing table (130) is at the same level as the secondary throwing table (29), an upper axle (95) that is coaxial with the main axle (60), the upper axle (95) being rotatably attached to an outward axle of the gear box (34) via transmission means (36, 77, 79), the upper axle (95) being operatively attached to a pushing rod (88) that is eccentrically positioned relative the upper axle (95), a substantially half circle shaped cam disc (90) attached to the pushing rod (88) and arranged to affect a linking system (134, 142, 144, 146, 148, 150) via a guide roll (138), in turn affecting the angle of the primary throwing table (130).

2. Clay pigeon throwing machine according to claim 1, wherein the electro-magnetic connector (50) is controlled by electronic components including a random generator.

3. Clay pigeon throwing machine according to claim 1, wherein the linking system (134, 142, 144, 146, 148, 150) comprises a shifting arm (150) which is disposed within an opening (152) in the primary throwing table (130), the shifting arm (150) is movable between a rearward position and a forward position so that when the primary throwing table (130) is in the first position, the shifting arm (150) is in the rearward position and when the primary throwing table (130) is in the second position, the shifting arm (150) is in the forward position.

4. Clay pigeon throwing machine according to claim 1, wherein a main arm (134) is rotatably attached to the frame (20), a linking arm (136) is operatively attached to the main arm (134) so that the linking arm (136) extends upwardly, a guide roll (138) is attached to the linking arm (136), a pulling spring (140) has one end attached to the main arm (134) and the opposite end attached to the frame (20) at a point that is above the main arm (134), a first pivot arm (142) has one end pivotally attached to a free end of the main arm (134) and the opposite end pivotally attached to the primary throwing table (130), a second pivot arm (144) has one end pivotally attached to the free end of the main arm (134) and the opposite end pivotally attached to one end a third pivot arm (146), an opposite end of a third pivot arm (146) is rotatably attached to an attachment (147), a fourth pivot arm (148) has one end pivotally attached to one end of the third pivot arm (146) and the opposite end pivotally attached to a shifting arm (150), a lower end of the shifting arm (150) is rotatably attached to a shaft (151) that is secured to the frame (20), and an upper end of the shifting arm (150) extends through an opening (152) in the primary throwing table (130).

5. Clay pigeon throwing machine according to claim 1, wherein the primary throwing table (130) is arranged with guide members (160, 166, 168) placed thereon in order to guide clay pigeons to a predetermined position on the primary throwing table (130) and dampening material (167) disposed thereon.

6. Clay pigeon throwing machine according to claim 5, wherein the guiding members (160, 166, 168) include a guiding plate (160) that is parallel to and placed a distance above the primary throwing table (130), the guiding plate (160) includes a curved portion (162) along a portion of a front edge thereof, the curved portion (162) has a chamfered portion (164), a sliding plate (129) located above the primary throwing table, the sliding plate (129) defines an opening (131) so that the curved portion (162) and the chamfered portion (164) of the guiding plate (160) guide a clay pigeon onto the primary throwing table (130) when the clay pigeon is permitted to fall through the opening (131) defined in the sliding plate (129).

7. Clay pigeon throwing machine according to claim 6, wherein a spring biased clay pigeon holding wheel (170) is adapted to prevent three clay pigeons, that are positioned above a bottom clay pigeon, from falling into the opening (131) defined in the sliding plate (129) when the stack of clay pigeons is placed above the opening.

8. Clay pigeon throwing machine according to claim 1, wherein the upper axle (95) is arranged with a feeding member (102) that is designed to mesh with a dividing plate (120) that is attached to the storage (123) so that when the upper axle (95) is rotated, the storage (123) is rotated a predetermined distance.

9. Clay pigeon throwing machine according to claim 8, wherein a feeding member (102) comprises a socket (103) that is secured to the upper axle (95), a disc shaped flange (104) operatively attached to the socket (103), two feeder rolls (105, 106) rotatably attached on the flange (104), with one of the feeder rolls being about twice as high as the other feeder roll, a spring biased setting member (114) adapted to fit into a first groove (110) and a second groove (112) defined in the upper axle (95) so that the feeding member (102) is axially shiftable by moving the setting member (114) between the first and the second groove.

10. Clay pigeon throwing machine according to claim 8, wherein a sliding plate (129) is attached under the storage (123) so that clay pigeons stored in the storage are permitted to slide on the sliding plate (129) when the storage (123) is rotated, the sliding plate (129) defines an opening (131) that is disposed above an inner edge of the primary throwing table (130), and the feeding member (102) turns the storage (123) so that one or two stacks of clay pigeons are positioned over the opening by rotating the upper axle (95) 360°.

11. Clay pigeon throwing machine according to claim 1, wherein the pushing rod (88), due to the rotation of the outward axle of the gear box, the transmission means (36, 77, 79) and the upper axle (95), operatively engages the throwing arm (75) that is secured to the main axle (60) and thereby rotates the main axle (60).

12. Clay pigeon throwing machine according to claim 1, wherein a spring biased positioning member (82) defines a position between the main axle (60) and the upper axle (95) when the pushing rod (88) is in contact with the throwing arm (75).

* * * * *